US010738792B2

(12) United States Patent
Christ et al.

(10) Patent No.: US 10,738,792 B2
(45) Date of Patent: Aug. 11, 2020

(54) VORTEX PUMP

(71) Applicant: KSB Aktiengesellschaft, Frankenthal (DE)

(72) Inventors: Alexander Christ, Frankenthal (DE); Jochen Fritz, Frankenthal (DE); Christoph Jaeger, Frankenthal (DE); Toni Klemm, Frankenthal (DE); Steffen Schmidt, Frankenthal (DE); Rolf Witzel, Frankenthal (DE)

(73) Assignee: KSB Aktiengesellschaft, Frankenthal (DE)

( * ) Notice: Subject to any disclaimer, the term of this patent is extended or adjusted under 35 U.S.C. 154(b) by 142 days.

(21) Appl. No.: 15/741,157

(22) PCT Filed: Jun. 27, 2016

(86) PCT No.: PCT/EP2016/064855
§ 371 (c)(1),
(2) Date: Dec. 29, 2017

(87) PCT Pub. No.: WO2017/001340
PCT Pub. Date: Jan. 5, 2017

(65) Prior Publication Data

US 2018/0187692 A1 Jul. 5, 2018

(30) Foreign Application Priority Data

Jun. 30, 2015 (DE) ..... 10 2015 212 203

(51) Int. Cl.
*F04D 29/24* (2006.01)
*F04D 29/22* (2006.01)

(52) U.S. Cl.
CPC ..... *F04D 29/242* (2013.01); *F04D 29/2244* (2013.01); *F05B 2240/30* (2013.01); *F05B 2250/15* (2013.01); *F05B 2260/63* (2013.01)

(58) Field of Classification Search
CPC .... F04D 29/24; F04D 29/242; F04D 29/2244; F04D 29/2288; F04D 29/666; F04D 7/04; F04D 7/045; B02C 18/0092
See application file for complete search history.

(56) References Cited

U.S. PATENT DOCUMENTS 4,076,179 A * 2/1978 Tsukube ..... B02C 18/0092 241/185.6
4,592,700 A * 6/1986 Toguchi ..... F04D 29/2244 415/225

(Continued)

FOREIGN PATENT DOCUMENTS

| | | | |
|---|---|---|---|
| AT | 83294 | B | 3/1921 |
| CN | 1113551 | A | 12/1995 |
| DE | 470 221 | C | 1/1929 |
| DE | 943 803 | B | 6/1956 |

(Continued)

OTHER PUBLICATIONS

Summary: English Machine Translation of CN1113551A (dated Year: 1995).*
English Translation of Chinese-language Office Action issued in counterpart Chinese Application No. 201680037160.0 dated Dec. 29, 2018 (four (4) pages).

(Continued)

*Primary Examiner* — Richard A Edgar
*Assistant Examiner* — Michael K. Reitz
(74) *Attorney, Agent, or Firm* — Crowell & Moring LLP

(57) ABSTRACT

A vortex pump with an impeller is provided. The impeller includes blades for delivering solids-containing media which are arranged in bundles. The spacing the blades in the bundles is smaller than the spacing of the bundles from each other.

23 Claims, 8 Drawing Sheets

(56) References Cited

U.S. PATENT DOCUMENTS

| | | | | |
|---|---|---|---|---|
| 6,514,036 | B2 * | 2/2003 | Marshall | E01H 1/0809 415/102 |
| 8,511,998 | B2 * | 8/2013 | Burgess | F04D 29/2288 416/185 |

FOREIGN PATENT DOCUMENTS

| | | | |
|---|---|---|---|
| DE | 3811990 | A1 | 10/1988 |
| EP | 1 616 100 | B1 | 2/2010 |
| FR | 1 404 875 | A | 7/1965 |
| JP | 2013-181459 | A | 9/2013 |
| WO | WO 2004/065796 | A1 | 8/2004 |
| WO | WO 2004/065797 | A1 | 8/2004 |

OTHER PUBLICATIONS

International Preliminary Report on Patentability (PCT/IB/338 & PCT/IB/373) issued in PCT Application No. PCT/EP2016/064855 dated Jan. 11, 2018, including English translation of Document C3 (German-language Written Opinion (PCT/ISA/237)) filed on Dec. 29, 2017 (Nine (9) pages).

German Search Report issued in counterpart German Application No. 10 2015 212 203.4 dated Jun. 27, 2016 with partial English-language translation (Thirteen (13) pages).

International Search Report (PCT/ISA/210) issued in PCT Application No. PCT/EP2016/064855 dated Aug. 26, 2016 with English-language translation (Nine (9) pages).

German-language Written Opinion (PCT/ISA/237) issued in PCT Application No. PCT/EP2016/064855 dated Aug. 26, 2016 (Six (6) pages).

* cited by examiner

VORTEX PUMP

CROSS REFERENCE TO RELATED APPLICATIONS

This application is a National Phase of PCT International Application No. PCT/EP2016/064855, filed Jun. 27, 2016, which claims priority under 35 U.S.C. § 119 from German Patent Application No. 10 2015 212 203.4, filed Jun. 30, 2015, the entire disclosures of which are herein expressly incorporated by reference.

BACKGROUND AND SUMMARY OF THE INVENTION

This invention relates to a non-chokable pump comprising an impeller which has blades for delivering solids-containing media.

Such non-chokable pumps are also referred to as vortex pumps, the delivery power of which is transferred from a rotating plate provided with blades, the so-called non-chokable impeller, to the flow medium. Non-chokable impellers are particularly suitable for delivering media mixed with solid additions, such as for example dirty water. The non-chokable impeller is a radial impeller which has a large passage for the solids contained in the delivery medium and has a low susceptibility to faults.

A non-chokable pump for delivering liquids mixed with solid additions is described in WO 2004/065796 A1. There is a spacing between the impeller and the suction-side casing wall, in order that solid bodies can pass through the non-chokable pump without blockages. The transition from the suction-side casing wall to the wall of the casing space, which space is situated radially with respect to the impeller, is realized smoothly. The casing space is of asymmetric design.

A non-chokable pump whose impeller consists of a support plate equipped with open blades is described in EP 1 616 100 B1. The blades have different heights. A suction-side casing wall runs conically. The spacing of the casing wall to the front edges of the relatively high blades of the impeller decreases with diameter. A passage with a minimum extent follows a front edge of a blade of relatively low height, which blade is inclined toward the impeller outlet, in a constant manner.

Referred to as a ball passage is a free, non-constricted impeller passage. It describes the largest permissible diameter of the solids for ensuring a blockage-free passage. It is specified as a ball diameter in millimeters. The ball passage corresponds, at most, to the nominal width of the suction or discharge connector. In order that this maximum possible ball passage is achieved in conventional non-chokable pumps, it is also necessary that, inside the casing, the spacing of the blade front to the suction-side casing wall likewise corresponds to at least the nominal width of the suction or discharge connector.

If the bladeless space between the blade front and the opposite casing wall exceeds a certain dimension, the efficiency of the non-chokable pump is reduced. The larger the spacing between the impeller and the suction-side casing wall, the lower the efficiency of the non-chokable pump.

It is the object of the invention to specify a non-chokable pump which is able to deliver media even having relatively large solids and which has at the same time a highest possible efficiency according to the design. The non-chokable pump should be characterized by a production method which is as cost-effective as possible and ensure a long lifetime. Moreover, the non-chokable pump should be usable in as versatile a manner as possible and have low susceptibility to faults and have a favorable NPSH value. Cavitation damage should be avoided.

According to the invention, the blades are arranged in bundles on the non-chokable impeller. In this case, the spacing of the blades within the bundles is smaller than the spacing of the bundles to one another.

Due to the construction according to the invention, a sufficient ball passage together with high delivery efficiency of the pump is ensured.

The arrangement in bundles of the blades on the support plate allows the spacing between the inlet-side casing wall and the blade front to be reduced and at the same time a sufficient ball passage to still be ensured.

Since the spacings between the bundles are larger than the spacings of the blades in the bundles, a sufficiently large ball passage is ensured even for the case where the spacing of the blade front of the impeller is smaller than the inner diameter of the suction connector or discharge connector. As a result, blockages are avoided and at the same time high efficiency during delivery is ensured. The bundled arrangement of the blades allows the spacing of the impeller to the suction-side casing wall to be reduced without blockages occurring. The efficiency of the non-chokable pump is consequently increased.

Preferably, the spacing of the blade front of the impeller is less than 90%, in particular less than 80%, of the diameter of the suction mouth or the inner diameter of the suction connector.

Each bundle comprises at least two blades. Bundles with in each case two or three blades prove to be particularly favorable. In a variant of the invention, each bundle comprises four blades.

The support plate of the non-chokable impeller has a hub projection which is formed toward the suction side and on which the blades act. The blades project from the support plate in the suction-side direction and have a profile which is curved opposite to the rotational direction. Here, all the blades may have the same curvature. In an alternative variant, the blades have different curvatures. It is thus possible, for example, for blades with different curvatures to be arranged within a bundle.

Expediently, the spacing of the blades in the bundles is less than 90%, preferably less than 80%, in particular less than 70%, of the spacing of the bundles to one another.

In a particularly advantageous embodiment of the invention, the non-chokable impeller comprises two bundles of blades, which bundles are preferably arranged so as to be offset from one another by 180°. In this case, it proves to be favorable if each bundle comprises the same number of blades.

The spacings of the blades within the bundles and/or the spacings of the bundles to one another are preferably specified as angles of the blade separation. According to the invention, the angles of the blade separation within the bundles are smaller than the angles of the blade separation between the bundles.

Expediently, the angles of the blade separation between the bundles are more than 60°, preferably more than 70°, in particular more than 80°.

It proves to be favorable if the angles of the blade separation within the bundles are less than 70°, preferably less than 60°, in particular less than 50°.

In a particularly favorable embodiment of the invention, the impeller is formed integrally with the blades. Here, it proves to be favorable if the impeller and/or the blades are produced from a metallic material. Preferably, a cast material is used in this case.

In a variant of the invention, the angles of the blade separation between the bundles are not an integer multiple of the angles of the blade separation within the bundles, and so the arrangement in bundles does not stem from an impeller with blades of equal angular separation in which individual blades are omitted.

In a particularly favorable variant of the invention, the height of the blades decreases, in relation to a reference plane, in the radial direction. The decrease preferably occurs at a bevel angle of more than 2°, in particular more than 3°. It proves to be favorable if the decrease in the height of the blades occurs at a bevel angle of less than 8°, in particular less than 7°.

Further features and advantages of the invention will emerge from the description of exemplary embodiments on the basis of drawings, and from the drawings themselves.

DETAILED DESCRIPTION OF THE DRAWINGS

Figure 1:
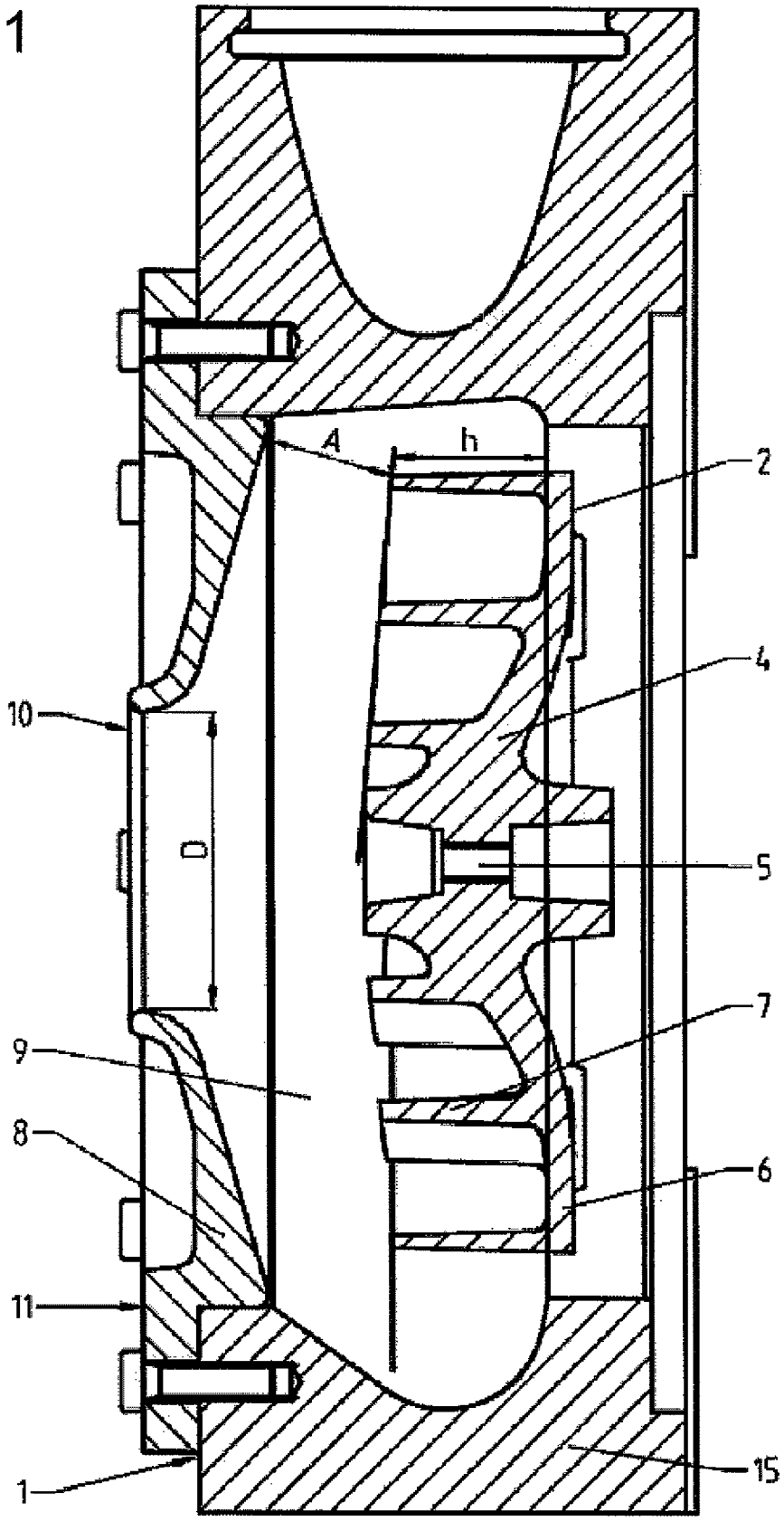
FIG. 1 shows a schematic meridional section through a non-chokable pump in accordance with the present invention.

FIG. 1 illustrates a non-chokable pump, in the casing 1 of which an impeller 2 is positioned. The impeller 2 is connected rotationally conjointly to a shaft (not illustrated in FIG. 1). A hub body 4 which has a bore 5 for screwing in a screw serves for the fastening of the impeller 2. The impeller 2 is designed as a non-chokable impeller. Multiple blades 7 are arranged on a support plate 6 of the impeller 2. A blade-free space 9 is formed between the impeller 2 and the inlet-side casing wall 8.

The suction mouth 10 is formed by a suction-side casing part 11. The suction mouth 10 forms an inlet for the solids-containing medium and has a diameter D. The suction-side casing part 11 is formed as a suction cover.

The impeller 2 is arranged in a pump casing 15.

The front side of the non-chokable impeller 2 has, at its outer edge, a spacing A to the inner side of the suction-side casing part 11. Here, the spacing A is preferably defined as the distance which a normal, which is perpendicular to the suction-side casing wall 8, has from the outer edge of the blade front of the impeller 2. The spacing A is smaller than the diameter D.

The height h of the blades 7 decreases in the radial direction, with the result that the blade front has a slightly inclined or conical profile.

Figure 2:
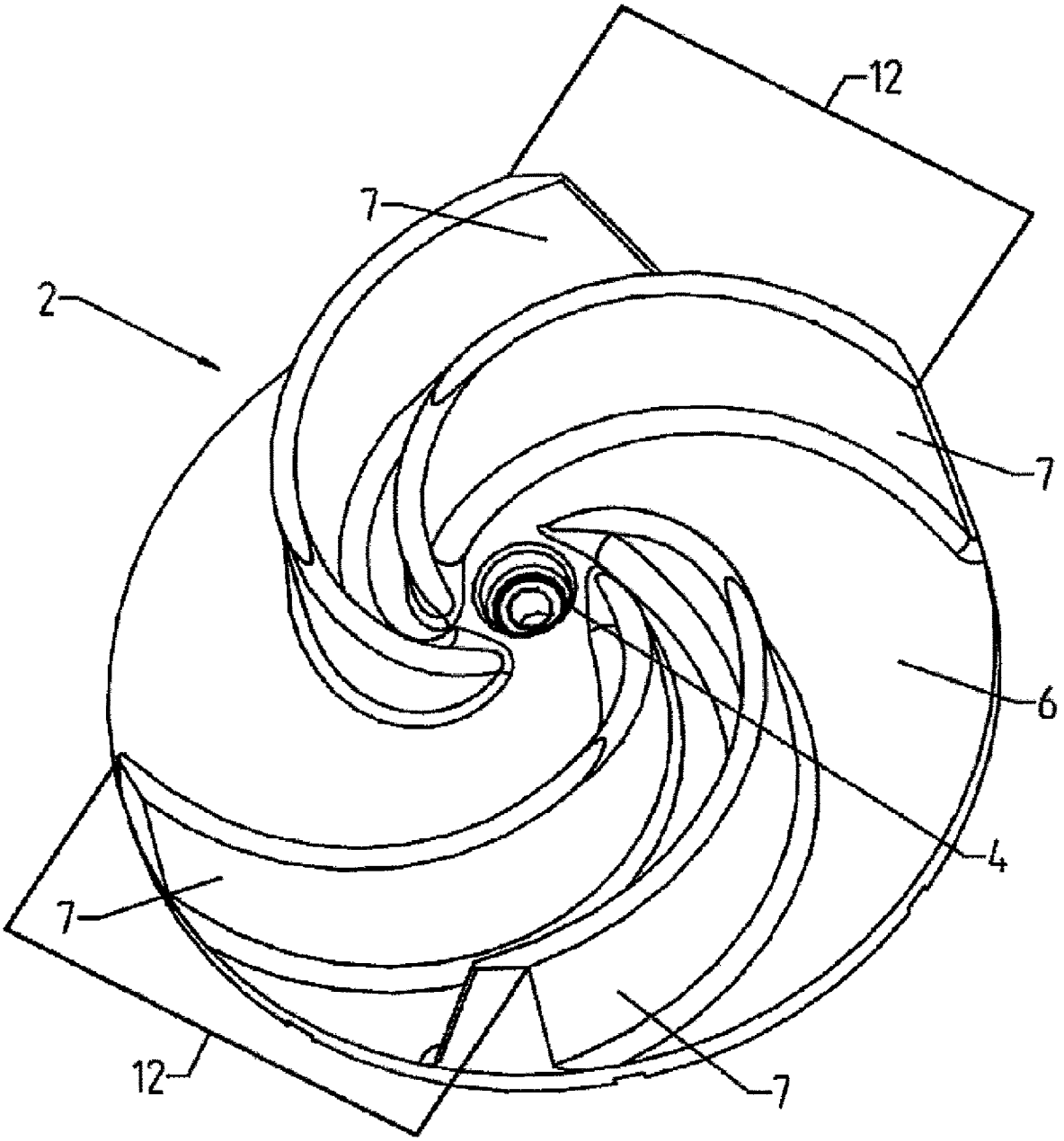
FIG. 2 shows a perspective illustration of a non-chokable impeller with two bundles which each have two blades in accordance with the present invention.

FIG. 2 shows a perspective illustration of the impeller 2, which is designed as a non-chokable impeller. The impeller 2 is an open radial impeller having no cover plate.

Two bundles 12 of blades 7 are arranged on the support plate 6. Each bundle 12 comprises in each case two blades 7. The two bundles 12 are arranged on the hub body 4 of the impeller 2 so as to be offset from one another by 180°.

Figure 3:
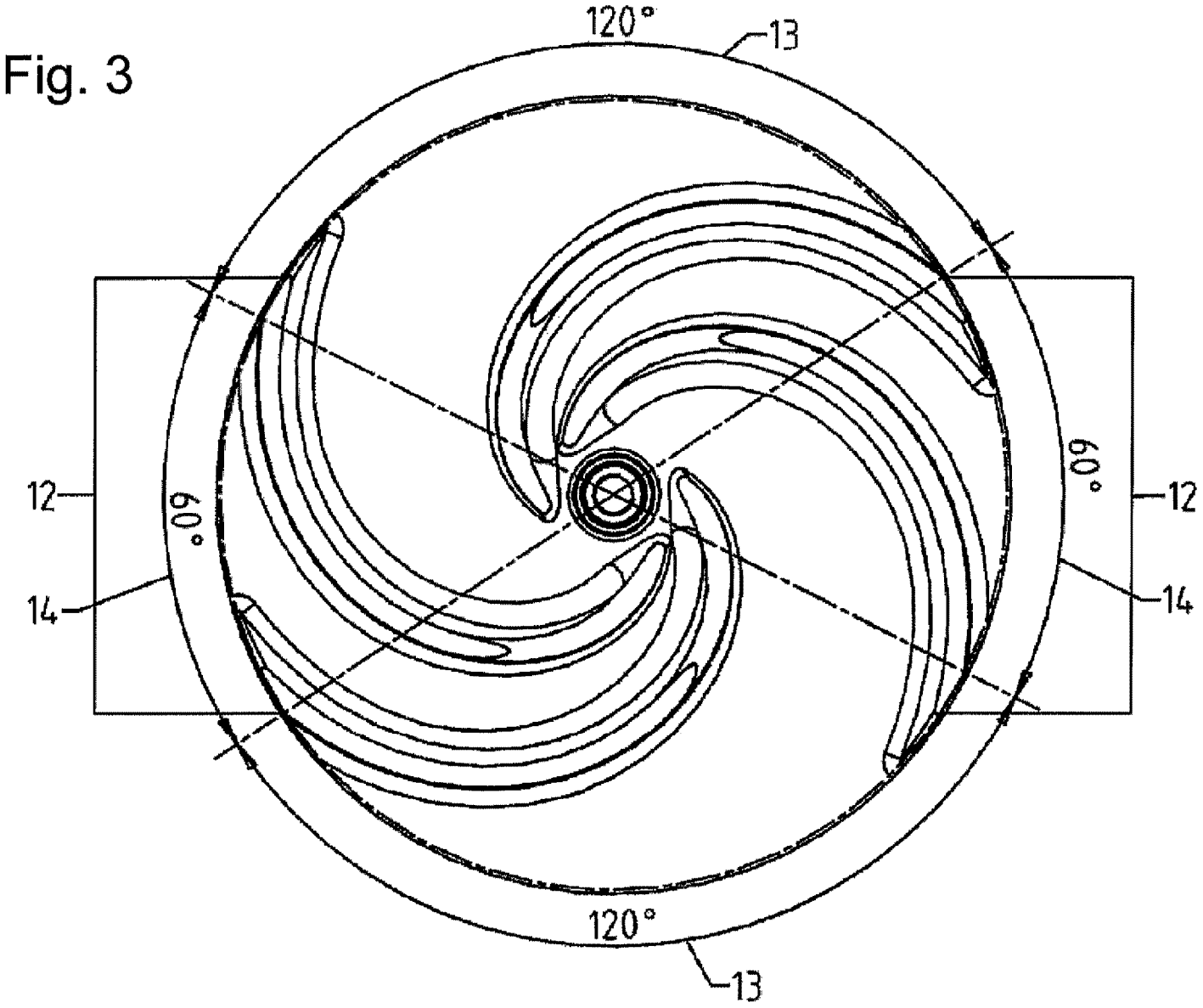
FIG. 3 shows a plan view of the non-chokable impeller according to the illustration in FIG. 2.

FIG. 3 shows a plan view of the impeller 2 according to the illustration in FIG. 2. The spacing 13 between the bundles has an angle of the blade separation of 120°. The spacing 14 of the blades 7 within the bundles 12 has an angle of the blade separation of 60°. The angles blade separation between the bundles 12 are thus larger than the angles of the blade separation within the bundles by a factor of 2. The angles of the blade separation between the bundles 12 are an integer multiple of the angles of the blade separation within the bundles 12.

Figure 4:
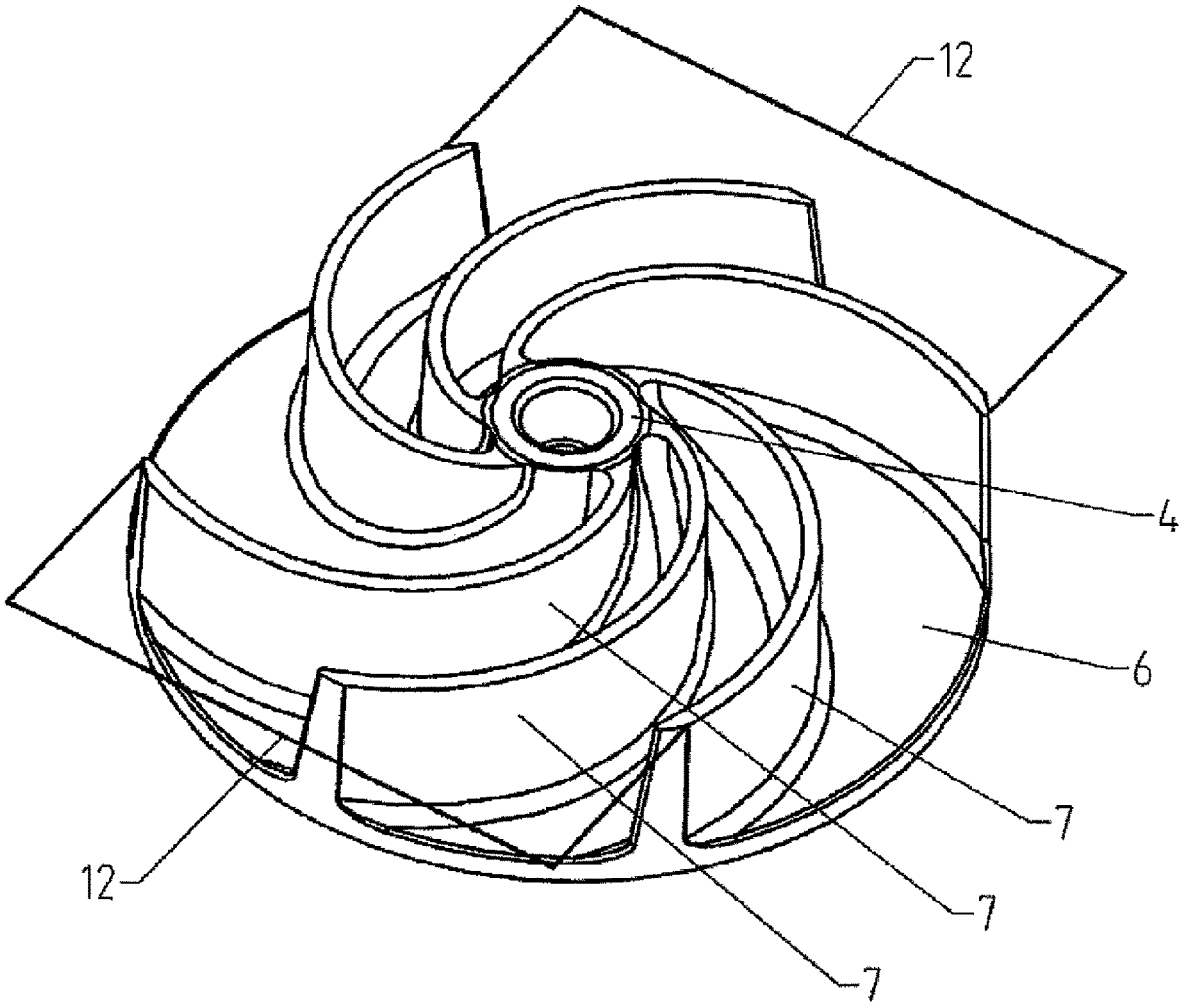
FIG. 4 shows a perspective illustration of a non-chokable impeller with two bundles which each have three blades in accordance with the present invention.

FIG. 4 shows a perspective illustration of an impeller 2, in which two bundles 12 of blades 7 are arranged on a support plate 6, wherein each bundle 12 comprises in each case three blades 7. The two bundles are arranged on the hub body 4 of the impeller 2 so as to be offset from one another by 180°.

Figure 5:
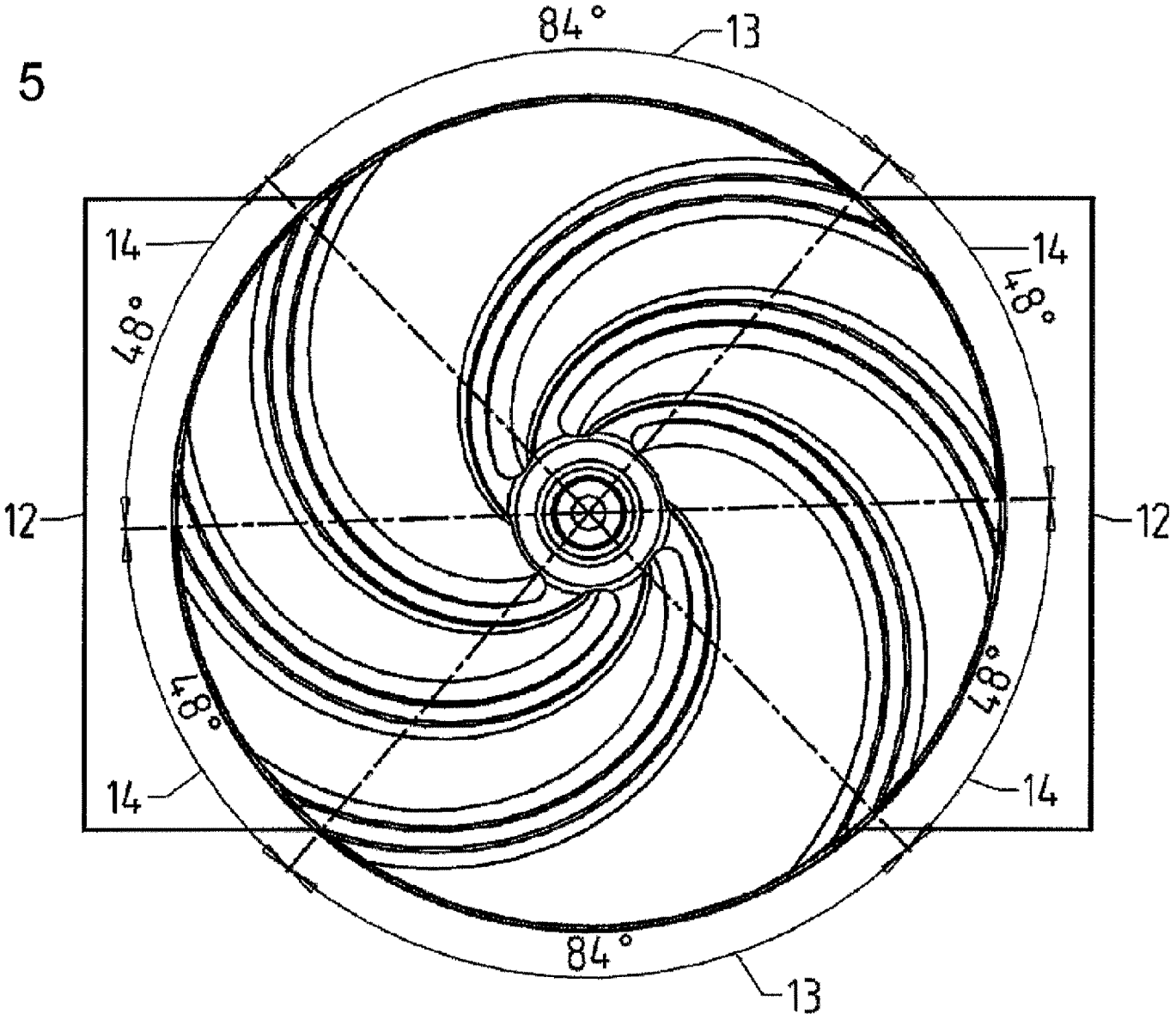
FIG. 5 shows a plan view of the non-chokable impeller according to the illustration in FIG. 4.

FIG. 5 shows a plan view of the impeller 2 according to the illustration in FIG. 4. The spacing 13 between the bundles 12 has an angle of the blade separation of 84°. The spacing 14 of the blades 7 within the bundles 12 has an angle of the blade separation of 48°. The angles of the blade separation between the bundles are thus larger than the angles of the blade separation within the bundles 12 by a factor of 1.75. Consequently, the angles of the blade separation between the bundles 12 are not an integer multiple of the angles of the blade separation within the bundles 12.

Figure 6:
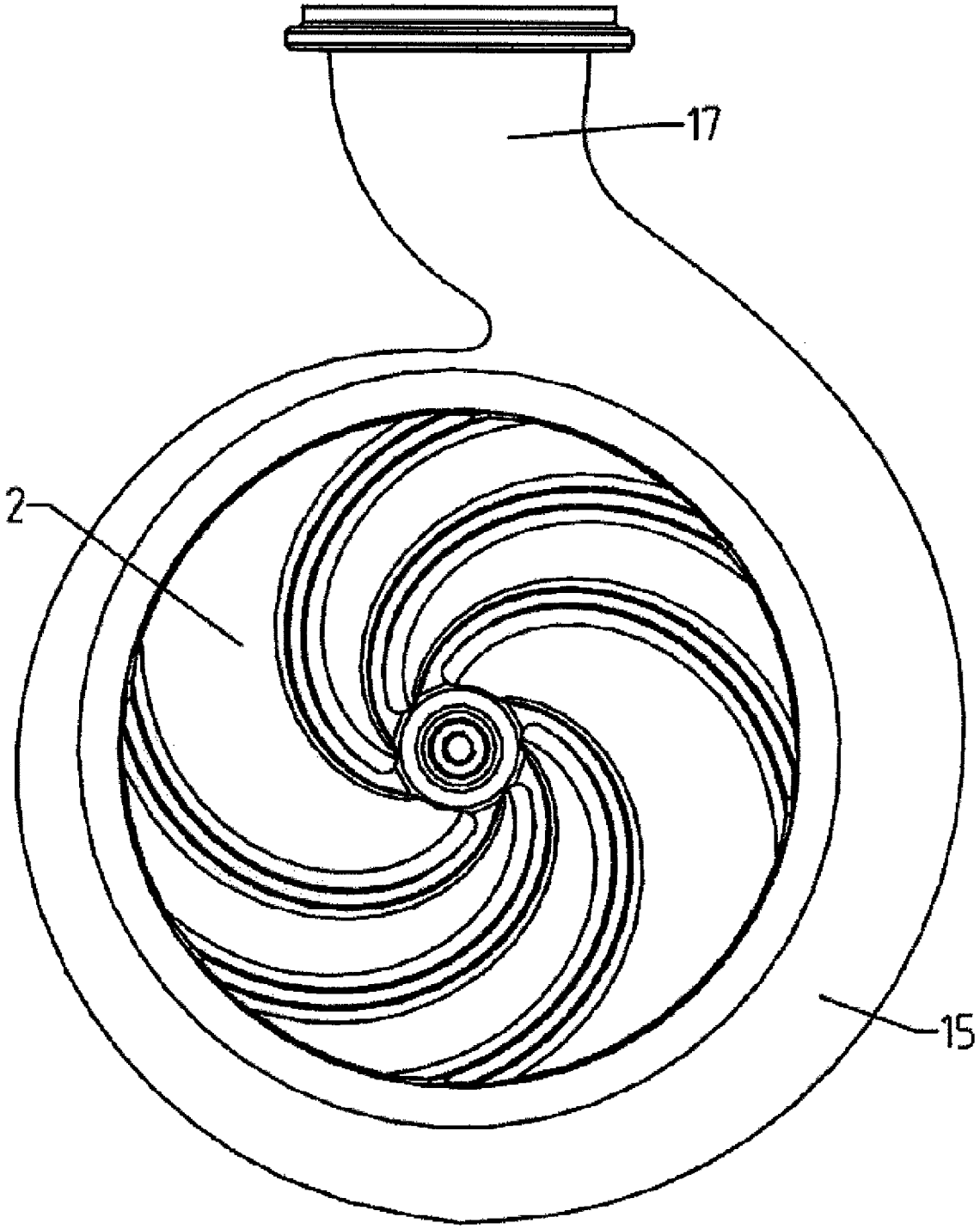
FIG. 6 shows an arrangement of a non-chokable impeller in a pump casing in accordance with the present invention.

FIG. 6 shows a view into the non-chokable pump, in which an impeller 2 is arranged in the pump casing part 15. The casing is a volute casing. The solids-containing medium exits the non-chokable pump through a discharge connector 17.

Figure 7:
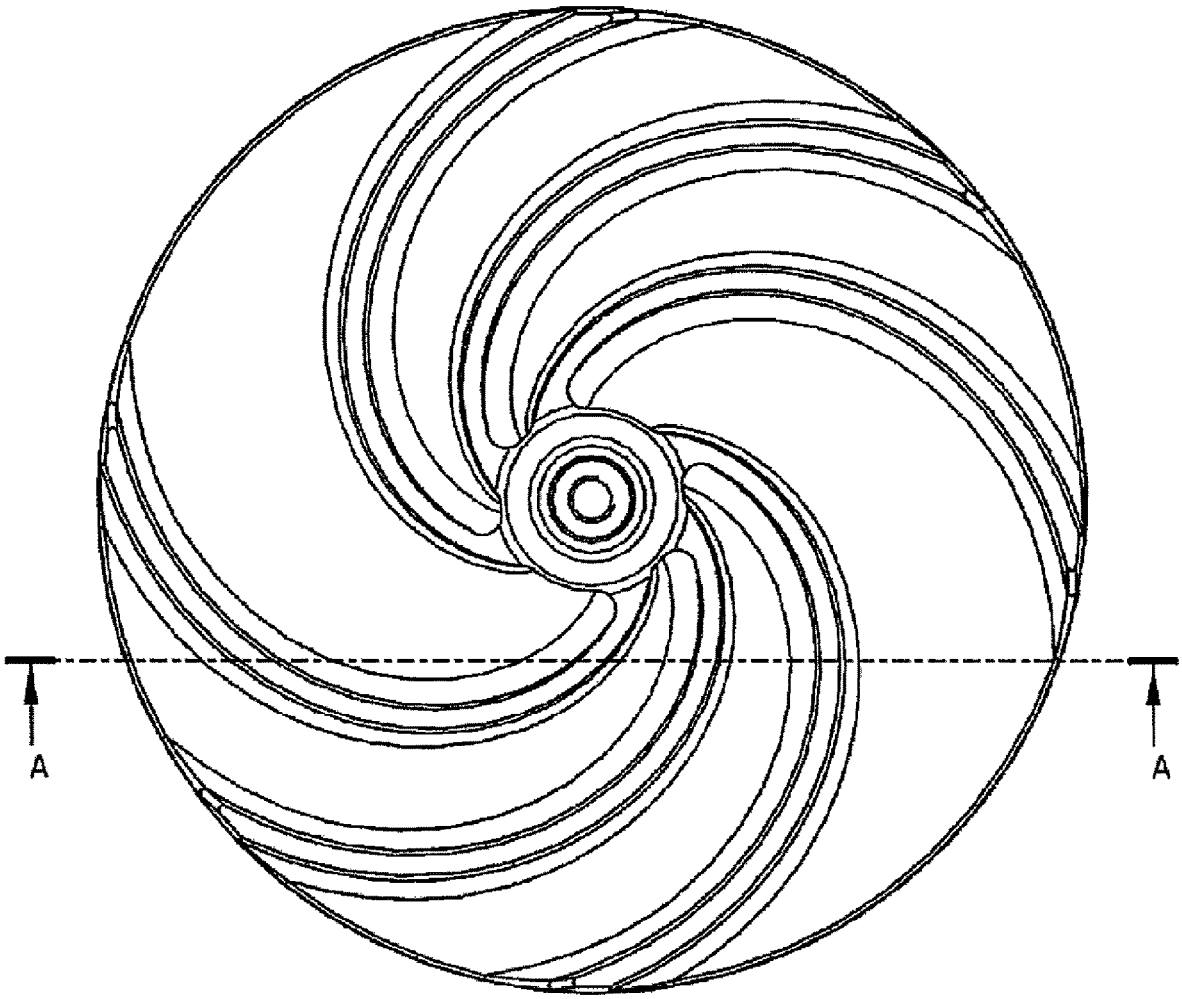
FIG. 7 shows a plan view of a non-chokable impeller with a section line A-A in accordance with the present invention.
Figure 8:
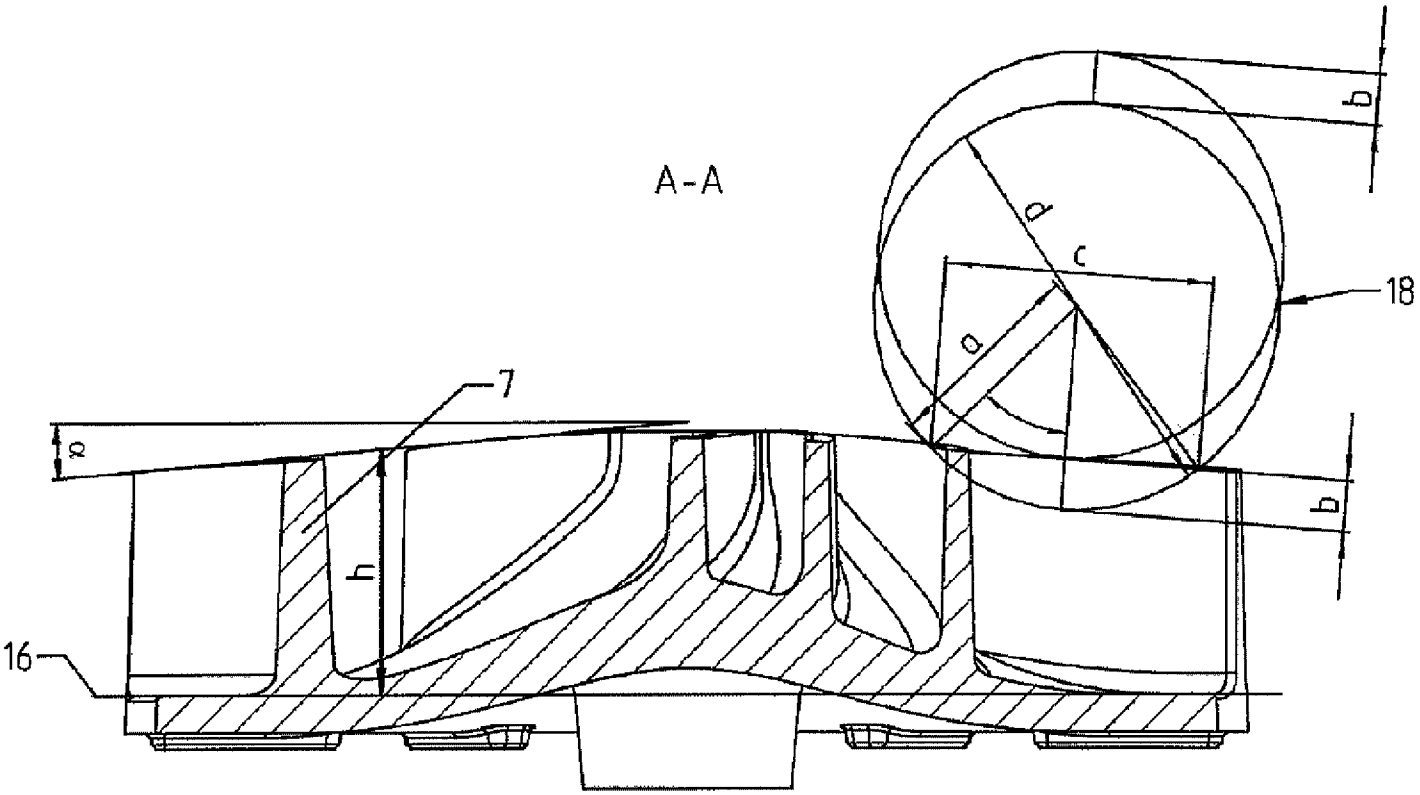
FIG. 8 shows a sectional illustration along the line A-A of the non-chokable impeller illustrated in FIG. 7.

FIG. 7 shows the impeller 2 according to the illustration in FIG. 6 with a section line A-A. A section along this line A-A is illustrated in FIG. 8. The height h of the blades 7 decreases in the radial direction, that is to say toward the impeller outer diameter. The decrease is in relation to a reference plane 16, which is partially illustrated by dashed lines in FIG. 8. In the exemplary embodiment, the decrease occurs at a bevel angle $\alpha$ of 5°.

FIG. 8 shows a ball 18 in an upper and a lower position. The ball 18 has a diameter d and a radius a. According to the lower position of the ball 18, the ball 18 dips by a depth b into the spaces of the impeller 2 between the bundles 12. This dipping segment of the ball has a secant c.

Due to arrangement according to the invention of the blades 7 in bundles 12, it is possible for a ball which has a diameter d which corresponds to the diameter of the suction mouth D to dip by a depth b into the spaces between the bundles 12. This allows the spacing A of the blade front to the suction-side casing wall 11 to be reduced in comparison with the diameter d by this depth b, with the result that the non-chokable pump has higher efficiency and still ensures the maximum ball passage d of the diameter D of the suction mouth 10. The following relationship exists between the spacing A, the depth b and the diameter D:

$$A+b=D \quad \text{(formula 1).}$$

The depth can be calculated as follows:

$$b = a - \sqrt{a^2 - \left(\frac{c}{2}\right)^2}. \quad \text{(formula 2)}$$

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A non-chokable pump, comprising:

a pump casing; and an impeller configured to be arranged within the pump casing, the impeller having blades configured to deliver solids-containing media, wherein the blades are arranged in bundles, the blades have the same axial height profile from a radially inner region of the impeller to a radially outer region of the impeller, a spacing of the blades within each of the bundles is smaller than a spacing of the bundles to one another, a spacing between the impeller and a wall of the pump casing containing a pump inlet is smaller than a diameter of the pump inlet, and large enough that a ball having a diameter equal to the pump inlet diameter is passable from the pump inlet to the pump outlet by dipping a portion of the ball into a space between the bundles.

2. The non-chokable pump as claimed in claim 1, wherein each bundle has at least two blades.

3. The non-chokable pump as claimed in claim 2, wherein each bundle includes at most four blades.

4. The non-chokable pump as claimed in claim 3, wherein the spacing of the blades in each bundle is less than 90% of the spacing of the bundles to one another.

5. The non-chokable pump as claimed in claim 3, wherein the spacing of the blades in each bundle is less than 80% of the spacing of the bundles to one another.

6. The non-chokable pump as claimed in claim 3, wherein the spacing of the blades between the bundles is more than 60°.

7. The non-chokable pump as claimed in claim 3, wherein the spacing of the blades between the bundles is more than 80°.

8. The non-chokable pump as claimed in claim 4, wherein the spacing of the blades within each of the bundles is less than 70°.

9. The non-chokable pump as claimed in claim 4, wherein the spacing of the blades within each of the bundles is less than 50°.

10. The non-chokable pump as claimed in claim 1, wherein the impeller is formed integrally with the blades.

11. The non-chokable pump as claimed in claim 10, wherein at least one of the impeller and the blades is produced from a metallic material.

12. The non-chokable pump as claimed in claim 11, wherein the metallic material is a cast material.

13. The non-chokable pump as claimed in claim 1, wherein a spacing of a blade front of the blades at an outer radius of the impeller to a suction-side casing wall of the pump casing is less than 90% of a diameter of at least one of a pump casing inlet opening and a pump casing outlet opening.

14. The non-chokable pump as claimed in claim 13, wherein the spacing of the blade front of the blades is less than 80% of the diameter of the at least one of the pump casing inlet opening and the pump casing outlet opening.

15. The non-chokable pump as claimed in claim 3, wherein each bundle includes comprises an equal number of blades.

16. The non-chokable pump as claimed in claim 15, wherein the bundles are offset from one another by 180°.

17. The non-chokable pump as claimed in claim 3, wherein an angle of blade separation between the bundles is larger than an angle of the blade separation within the bundles by more than a factor of 1.2.

18. The non-chokable pump as claimed in claim 3, wherein an angle of blade separation between the bundles is larger than an angle of the blade separation within the bundles by more than a factor of 1.6.

19. The non-chokable pump as claimed in claim 3, wherein an angle of the blade separation between the bundles is not an integer multiple of an angle of the blade separation within the bundles.

20. The non-chokable pump as claimed in claim 1, wherein a height of the blades decreases in the radial direction at a bevel angle of more than 2° less than 8°.

21. The non-chokable pump as claimed in claim 1, wherein at least two of the blades have different curvatures.

22. The non-chokable pump as claimed in claim 1, wherein a curvature of all the blades is the same.

23. The non-chokable pump as claimed in claim 21, wherein the bevel angle is more than 3° less than 7°.

* * * * *